US008821654B2

(12) United States Patent
Gleeson et al.

(10) Patent No.: US 8,821,654 B2
(45) **Date of Patent: *Sep. 2, 2014**

(54) PT METAL MODIFIED γ-NI+γ'-NI$_3$AL ALLOY COMPOSITIONS FOR HIGH TEMPERATURE DEGRADATION RESISTANT STRUCTURAL ALLOYS

(75) Inventors: Brian M. Gleeson, Sewickley, PA (US); Daniel J. Sordelet, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 627 days.

This patent is subject to a terminal disclaimer.

(21) Appl. No.: 12/173,683

(22) Filed: Jul. 15, 2008

(65) Prior Publication Data

US 2010/0012235 A1 Jan. 21, 2010

(51) Int. Cl.
*C22C 19/03* (2006.01)
*C22F 1/10* (2006.01)

(52) U.S. Cl.
USPC ..... 148/409; 148/675; 420/456

(58) Field of Classification Search
CPC ..... C22C 19/03
USPC ..... 420/456; 148/428, 409
See application file for complete search history.

(56) References Cited

U.S. PATENT DOCUMENTS 3,754,902 A * 8/1973 Boone et al. ..... 420/443
3,918,139 A 11/1975 Felten
3,933,483 A 1/1976 Komatsu et al.
3,976,436 A 8/1976 Chang
4,019,900 A 4/1977 Raghavan et al.
4,123,594 A 10/1978 Chang
4,123,595 A 10/1978 Chang
4,339,509 A 7/1982 Dardi et al.
4,346,137 A 8/1982 Hecht
4,392,894 A 7/1983 Pearson et al.
4,737,205 A * 4/1988 Selman et al. ..... 148/410
4,743,514 A 5/1988 Strangman et al.
4,758,480 A 7/1988 Hecht et al.
5,240,491 A 8/1993 Budinger et al.
5,435,861 A 7/1995 Khan et al.
5,514,482 A 5/1996 Strangman
5,667,663 A 9/1997 Rickerby et al.
5,763,107 A 6/1998 Rickerby et al.
5,942,337 A 8/1999 Rickerby et al.

(Continued)

FOREIGN PATENT DOCUMENTS

CA 1251059 3/1989
DE 29 08 151 10/1979

(Continued)

OTHER PUBLICATIONS

Office Action, dated Jan. 26, 2009, for Canadian application No. 2,525,320 from the Canadian Patent Office, (3 pages).

(Continued)

*Primary Examiner* — Jessee Roe
(74) *Attorney, Agent, or Firm* — Shumaker & Sieffert, P.A.

(57) ABSTRACT

An alloy comprising 5 at %≤Al<16 at %, about 0.05 at % to 1 at % of a reactive element selected from the group consisting of Hf, Y, La, Ce, Zr, and combinations thereof, and Ni, wherein the alloy composition has a predominately γ-Ni+γ'-Ni$_3$Al phase constitution.

14 Claims, 16 Drawing Sheets

1150°C Ni-Al-Pt phase diagram

(56) References Cited

U.S. PATENT DOCUMENTS

| | | | |
|---|---|---|---|
| 5,981,091 | A | 11/1999 | Rickerby et al. |
| 6,306,524 | B1 | 10/2001 | Spitsberg et al. |
| 6,436,473 | B2 | 8/2002 | Darolia et al. |
| 6,485,844 | B1 | 11/2002 | Strangman et al. |
| 6,554,920 | B1 | 4/2003 | Jackson et al. |
| 6,585,878 | B2 | 7/2003 | Strangman et al. |
| 7,229,701 | B2 | 6/2007 | Madhava et al. |
| 7,264,888 | B2 | 9/2007 | Darolia et al. |
| 7,273,662 | B2 | 9/2007 | Gleeson et al. |
| 7,316,850 | B2 | 1/2008 | Hu et al. |
| 7,531,217 | B2 | 5/2009 | Gleeson et al. |
| 2002/0009611 | A1 | 1/2002 | Darolia et al. |
| 2002/0132132 | A1 | 9/2002 | Bose et al. |
| 2002/0187336 | A1 | 12/2002 | Khan et al. |
| 2004/0229075 | A1 | 11/2004 | Gleeson et al. |
| 2005/0003227 | A1 | 1/2005 | Khan et al. |
| 2006/0093752 | A1 | 5/2006 | Darolia et al. |
| 2006/0093801 | A1 | 5/2006 | Darolia et al. |
| 2006/0093850 | A1 | 5/2006 | Darolia et al. |
| 2006/0093851 | A1 | 5/2006 | Darolia et al. |
| 2006/0127695 | A1 | 6/2006 | Gleeson et al. |
| 2006/0210825 | A1 | 9/2006 | Gleeson et al. |
| 2006/0292390 | A1 | 12/2006 | Kassner et al. |
| 2007/0071995 | A1 | 3/2007 | Hazel et al. |
| 2007/0071996 | A1 | 3/2007 | Hazel et al. |
| 2008/0038582 | A1 | 2/2008 | Gleeson et al. |

FOREIGN PATENT DOCUMENTS

| | | | |
|---|---|---|---|
| EP | 0 652 299 | A1 | 5/1995 |
| EP | 0 718 420 | A1 | 6/1996 |
| EP | 1 111 192 | A1 | 6/2001 |
| EP | 1111091 | A1 | 6/2001 |
| EP | 1 321 541 | A2 | 6/2003 |
| EP | 1327702 | A1 | 7/2003 |
| GB | 2 029 857 | A | 3/1980 |
| JP | 58037144 | A | 3/1983 |
| JP | 58073761 | A | 5/1983 |
| JP | 04358037 | A | 12/1992 |
| JP | 05033091 | A | 2/1993 |
| JP | 07-247803 | | 9/1995 |
| JP | 08-225959 | | 9/1996 |
| JP | 2003-049231 | | 2/2003 |
| WO | WO 01/75192 | A3 | 10/2001 |
| WO | WO 2004/104243 | A2 | 12/2004 |
| WO | WO 2006/076130 | A2 | 7/2006 |
| WO | WO 2007/008227 | A3 | 1/2007 |

OTHER PUBLICATIONS

Office Action dated Jan. 28, 2009 for U.S. Appl. No. 11/206,663, (20 pages).

Office Action for Australian Patent Application No. 2005324336, from IP Australia, dated Dec. 19, 2008, (2 pages).

Communication of a notice of opposition from the European Patent Office for counterpart EP patent No. 1784517 dated Nov. 10, 2009 (1 page).

Opposition filed by Siemens AG with the European Patent Office dated Oct. 30, 2009 for EP patent No. 1784517 along with the English translation of the Opposition (17 Pages).

Office Action dated Jan. 8, 2010 for U.S. Appl. No. 11/893,576, (9 pages).

Office Action, dated Aug. 19, 2009, for Canadian application No. 2,597,898 from the Canadian Patent Office, (4 pages).

Translated Office Action for Mexican Patent Application No. MX/a/2007/007096, from the Mexican Patent Office, dated Nov. 22, 2009, (3 pages).

Final Office Action dated Oct. 22, 2009 for U.S. Appl. No. 11/206,663, (19 pages).

First Office Action (Non-Final Notice of Reasons for Rejection) for Japanese application No. 2006-532957 dated Jan. 14, 2010 in Japanese with an English translation, (7 pages).

PCT Notification of Transmittal of the International Search Report and Written Opinion of the International Searching Authority, or the Declaration from PCT Application No. PCT/US2009/052415, mailed Mar. 2, 2010 (14 pages).

Wright et al., "Mechanisms governing the performance of thermal barrier coatings," Current Opinion in Solid State and Materials Science, vol. 4, 1999, pp. 255-265.

Office Action from U.S. Appl. No. 11/893,576, dated Jul. 22, 2010, 19 pp.

Office Action from U.S. Appl. No. 11/206,663, dated Apr. 27, 2010, 19 pp.

Japanese Office Action (in Japanese) dated Jun. 30, 2009 and Appendix translated into English for Japanese patent application No. 2007-547002 (6 pages).

Leyens et al., "R&D Status and Needs for Improved EB-PVD Thermal Barrier Coating Performance," *Mat. Res. Soc. Symp. Proc.*, 2001, vol. 645E, pp. M10.1.1-M10.1.12.

Peters et al., "EB-PVD Thermal Barrier Coatings for Aeroengines and Gas Turbines," *Advanced Engineering Materials*, 2001, 3(4):193-204.

V.K. Tolpygo and D.R. Clarke, "Microstructural study of the theta-alpha transformation in alumina scales formed on nickel-aluminides," *Materials at High Temperatures*, vol. 17, No. 1, pp. 59-70 (2000).

J.A. Haynes, B.A. Pint, W.D. Porter and I.G. Wright, "Comparison of thermal expansion and oxidation behavior of various high-temperature coating materials and superalloys," *Materials at High Temperatures*, vol. 21, No. 2, pp. 87-94 (2004).

PCT International Search Report and PCT Written Opinion from PCT Application No. PCT/US2004/014740, mailed Mar. 2, 2005 (9 pages).

International Preliminary Report on Patentability from patent application No. PCT/US2004/014740, mailed, Dec. 1, 2005, (7 pages).

Murakami et al., "Distribution of Platinum Group Metal in Ni-Base Single-Crystal Superalloys", Superalloys Proceedings International Symposium Superalloys, Sep. 17, 2000, pp. 747-756; XP009057026.

Reid et al., "Microstructural Transformations in Platinum Aluminide Coated CMSX-4 Superalloy", Materials Science Forum vols. 461-464, pp. 343-350, (2004), XP009077214.

Goebel et al., "Interdiffusion between the platinum-modified aluminide coating RT 22 and nickel-based single-crystal superalloys at 1000 and 1200° C.", Materials at High Temperatures, vol. 12, No. 4, pp. 301-309, (1994), XP009077277.

Chen et al., "Degradation of the platinum aluminide coating on CMSX4 at 1100° C.", Surface & Coatings Technology, pp. 69-77, (1997), XP-002416853.

International Preliminary Examination Report from PCT Application Serial No. PCT/US05/029493, mailed Jun. 21, 2007, 7 pages.

International Preliminary Examination Report on Patentability for PCT Application Serial No. PCT/US05/045927 mailed Apr. 4, 2007 (28 pages).

PCT International Search Report and PCT Written Opinion from PCT Application No. PCT/US2005/029493, mailed Feb. 8, 2007, (12 pages).

PCT International Search Report and PCT Written Opinion from PCT Application No. PCT/US05/045927, mailed Jul. 19, 2007, (11 pages).

Communication pursuant to Article 96(2) EPC dated Jun. 11, 2007 for EP application No. 05 858 389.9 from the European Patent Office, (3 pages).

U.S. Appl. No. 11/744,633, filed May 4, 2007, (Continuation of U.S. Appl. No. 11/012,873).

U.S. Appl. No. 11/744,675, filed May 4, 2007, (Continuation of U.S. Appl. No. 10/439,649).

U.S. Appl. No. 11/744,622, filed May 4, 2007, (Continuation of U.S. Appl. No. 10/439,649).

U.S. Appl. No. 11/744,401, filed May 4, 2007, (Continuation of U.S. Appl. No. 10/439,649).

U.S. Appl. No. 11/744,634, filed May 4, 2007, (Continuation of U.S. Appl. No. 10/439,649).

U.S. Appl. No. 11/744,433, filed May 4, 2007, (Continuation of U.S. Appl. No. 11/206,663).

(56) References Cited

OTHER PUBLICATIONS

U.S. Appl. No. 11/744,453, filed May 4, 2007, (Continuation of U.S. Appl. No. 11/206,663).
U.S. Appl. No. 11/744,658, filed May 4, 2007, (Continuation of U.S. Appl. No. 11/206,663).
U.S. Appl. No. 11/744,653, filed May 4, 2007, (Continuation of U.S. Appl. No. 11/206,663).
Communication pursuant to Article 96(2) EPC dated Oct. 12, 2007 for EP application No. 05 857 130.8 from the European Patent Office, (3 pages).
Office Action dated Sep. 7, 2007 for U.S. Appl. No. 11/012,873, (13 pages).
Office Action dated Jun. 25, 2008 for U.S. Appl. No. 11/012,873, (9 pages).
Communication pursuant to Article 96(2) EPC, dated Jan. 17, 2008, for EP application No. 05 858 389.9 from the European Patent Office, (3 pages).
N. Vialas and D. Monceau, "Effect of Pt and Al content on the long-term, high temperature oxidation behavior and interdiffusion of a Pt-modified aluminide coating deposited on Ni-base superalloys", Surface & Coatings Technology, 201, (2006) pp. 3846-3851.
S. Hayashi et al., "Interdiffusion Behavior of Pt-Modified $\gamma$-Ni+$\gamma'$-$Ni_3Al$ Alloys Coupled to Ni—Al-Based Alloys", Metallurgical and Materials Transactions A, vol. 36A Jul. 2005, pp. 1769-1775.
Office Action dated Mar. 19, 2008, for U.S. Appl. No. 11/206,663, (18 pages).
Peggy Y. Hou, "Impurity Effects on Alumina Scale Growth", Journal of Am. Ceram. Soc., vol. 86, No. 4, 2003, pp. 660-668.
B. A. Pint et al., "Grain Boundary Segregation of Cation Dopants in $\alpha$-$Al_2O_3$ Scales", Journal of Electrochem. Soc.,vol. 145, No. 6, Jun. 1998, pp. 1819-1829.
Tresa M. Pollock et al., "Nickel-Based Superalloys for Advanced Turbine Engines: Chemistry, Microstructure, and Properties", Journal of Propulsion and Power, vol. 22, No. 2, Mar.-Apr. 2006, pp. 361-377.
Roger C. Reed, "The Superalloys Fundamentals and Applications", Cambridge University Press, 2006, (7 pages).
U.S. Appl. No. 12/183,709, filed Jul. 31, 2008, entitled "$\gamma'$-$Ni_3Al$ Matrix Phase Ni-Based Alloy and Coating Compositions Modified by Reactive Element Co-Additions and Si".
Office Action dated Sep. 12, 2008, for U.S. Appl. No. 11/206,663, (20 pages).
Office Action from U.S. Appl. No. 11/206,663, dated Nov. 24, 2010, 17 pp.
Office Action from U.S. Appl. No. 13/225,175, dated Dec. 20, 2011, 22 pp.
Office Action from U.S. Appl. No. 13/032,668, dated Aug. 19, 2011, 22 pp.
Office Action from U.S. Appl. No. 13/032,700, dated Dec. 21, 2011, 31 pp.
U.S. Appl. No. 13/226,835, by Brian Gleeson, filed Sep. 7, 2011.
U.S. Appl. No. 13/226,916, by Brian Gleeson, filed Sep. 7, 2011.
Office Action from U.S. Appl. No. 12/183,709, dated Apr. 26, 2012, 11 pp.

* cited by examiner

1150°C Ni-Al-Pt phase diagram

Weight Change of Ni-15Al Based γ/γ′ Alloys Oxidized at 1150° C Under Thermal Cycles

PT METAL MODIFIED γ-NI+γ'-$NI_3$AL ALLOY COMPOSITIONS FOR HIGH TEMPERATURE DEGRADATION RESISTANT STRUCTURAL ALLOYS

STATEMENT REGARDING FEDERALLY SPONSORED RESEARCH AND DEVELOPMENT

The U.S. Government has a paid-up license in this invention and the right in limited circumstances to require the patent owner to license others on reasonable terms as provided by the terms of Contract No. N00014-02-1-0733, awarded by the Office of Naval Research.

TECHNICAL FIELD

This invention relates to Ni—Al—Pt—Hf alloy compositions for high-strength, high temperature and oxidation resistant structural metal alloys.

BACKGROUND

Aerospace systems, as well as components for gas turbine and rocket engines, routinely require high temperature surface stability during service. Commercially available nickel-based superalloys with controlled microstructures, which rely on the formation of a continuous and adherent thermally grown oxide (TGO) scale of α-$Al_2O_3$ for extended resistance to degradation, may be used for high-strength thermal protection components. However, most commercial Ni-based superalloys were developed more for high-temperature strength than for oxidation resistance.

U.S. Pat. No. 7,273,662, incorporated herein by reference, describes alloy compositions and coatings including a Pt-group metal, Al, a reactive element such as Hf, and Ni, which have a predominately γ'-$Ni_3$Al+γ-Ni phase constitution. These alloy compositions are sufficiently low in Al content to be substantially free of β-NiAl, and form metallic coatings with improved reliability and durability. Further, these alloy compositions form highly adherent, slow-growing TGO scales during both isothermal and cyclic oxidation at high temperatures.

SUMMARY

To further enhance properties of certain γ'-$Ni_3$Al+γ-Ni alloys such as, for example, strength, toughness and ductility, the present disclosure is based in part on the finding that addition of up to about 20 at % of strengthening elements can be added without substantially altering the γ'-$Ni_3$Al+γ-Ni phase stability. Suitable strengthening elements in this context include, for example, Cr, Si, Co, Mo, Re, Ta, W and the like. The resultant strengthened alloy compositions form highly adherent, slow-growing TGO scales during both isothermal and cyclic oxidation at high temperatures up to at least about 1150-1200° C. The present disclosure is also based on the finding that controlling the Al content of certain γ'-$Ni_3$Al+γ-Ni alloy compositions to below about 16 at % renders them heat treatable.

In one aspect, this disclosure is directed to an alloy including 5 at %≤Al<16 at %, about 0.05 at % to 1 at % of a reactive element selected from the group consisting of Hf, Y, La, Ce, Zr, and combinations thereof, and Ni, wherein the alloy composition has a predominately γ-Ni+γ'-$Ni_3$Al phase constitution.

In another aspect, this disclosure is directed to a bulk alloy including about 13 at % Al to about 15 at % Al, about 0.05 at % to about 0.5 at % Hf, about 2.5 at % to about 5 at % of a Pt-group metal selected from Pt, Ir and combinations thereof, and Ni, wherein the alloy has a predominately γ-Ni+γ'-$Ni_3$Al phase constitution.

In yet another aspect, this disclosure is directed to a method for making an alloy composition including providing a bulk alloy including about 5 at % to about 16 at % Al, about 0.05 at % to about 1.5 at % of a reactive metal selected from the group consisting of Hf, Y, La, Ce, Zr, and combinations thereof, up to about 20 at % of a Pt group metal selected from the group consisting of Pt, Pd, Ir, Rh, Ru, and combinations thereof, and Ni, wherein the alloy has a predominately γ-Ni+γ'-$Ni_3$Al phase constitution; heating the bulk alloy to a temperature sufficient to substantially dissolve the γ'-$Ni_3$Al phase and form a γ-Ni phase; and quenching the bulk alloy at a temperature sufficient to precipitate the γ'-$Ni_3$Al phase within a γ-Ni matrix.

The alloy compositions may be particularly useful as high-temperature components that require both strength and oxidation resistance, such as thermal protection systems used in space re-entry and hypersonic aero systems, as well as for components used in gas turbine and rocket engines. The alloy compositions may be provided in such forms as, for example, bulk alloys, cast shapes, foils, claddings, or overlay-type coatings for metallic parts. The alloy compositions have excellent properties such as high-temperature strength and environmental resistance. Unlike conventional superalloys, the alloys described in this disclosure do not require a separate coating to enhance oxidation resistance at high temperatures.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 2 is a comparison of the as-heat-treated and thermally aged microstructures of Ni-15Al-0.1Hf base alloys containing 2.5Pt, 2.5Ir or 2.5Pt+2.5Ir addition and with and without further addition of 5Cr. The thermally aged alloys were heat treated at 1000° C. for 100 hours.

In the photographs and plots above, all compositions are nominal and set forth in atom percent. Like reference symbols in the various drawings indicate like elements.

DETAILED DESCRIPTION

Figure 1:
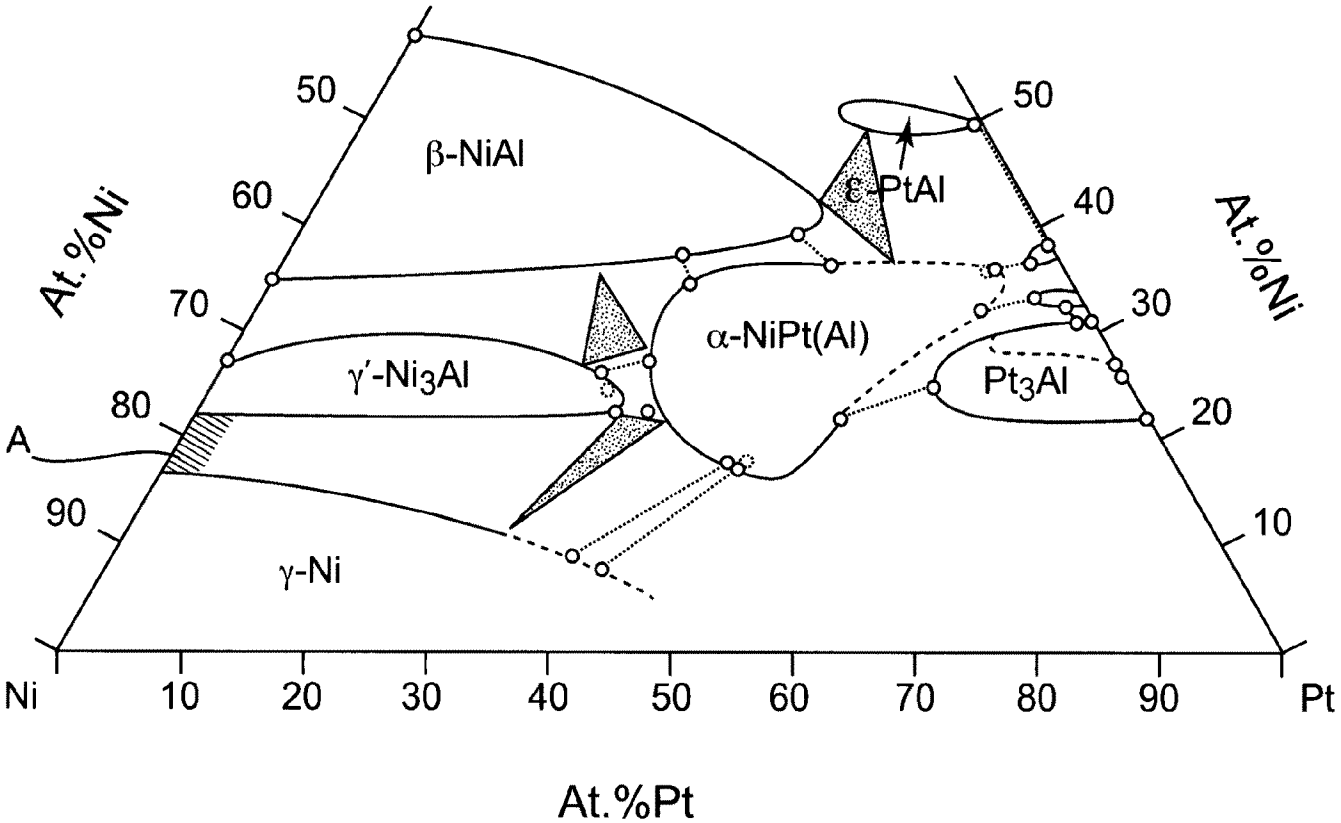
FIG. 1 is a portion of a 1100° C. Ni—Al—Pt phase diagram showing an embodiment of the Pt metal modified γ-Ni+γ"-$Ni_3$Al alloy compositions.

In one aspect, the present disclosure is directed to an alloy composition that includes 5 at %≤Al<16 at % Al, about 0.05 at % to 1 at % of a reactive element such as Hf, Y, La, Ce, Zr and combinations thereof, and Ni, and has a phase constitution that is predominately or solely γ-Ni+γ'-$Ni_3Al$. In some embodiments, the alloy further includes up to about 20 at % of a Pt-group metal such as Pt, Pd, Ir, Rh and combinations thereof. In other embodiments, the alloy includes up to about 20 at % of an additional strengthening element such as Cr and/or Si, and may also include refractory element such as such as Mo, Ta, Re, W, Ru, Ti and combinations thereof. As noted above, all at % values specified for all elements in this application are nominal, and may vary by as much as +1-2 at %.

Controlling the amount of Al in the alloy composition has a significant impact on the heat treatability of the composition. To maintain heat treatability, depending on the other elements present in the composition the Al content in the alloy should be maintained in the range of 5 at %≤Al<16 at %, or about 9 at % to about 15 at %, or about 9 at % to about 14 at %, or about 9 at % to about 13 at %, or 13 at %<Al<15 at %.

The addition of reactive elements such as Hf, Y, La, Ce and Zr, and combinations thereof, may tend to stabilize the γ' phase in the alloy composition. Therefore, if sufficient reactive metal is added to the composition, the resulting phase constitution may be predominately γ' or solely γ'. The reactive elements Hf, Y, La, Ce and Zr, and combinations thereof, are preferably present in the alloy at about 0.05 at % to about 1 at %. To provide excellent heat treatability, the reactive element is more preferably present at about 0.05 at % to 0.5 at %, and even more preferably at about 0.05 at % to about 0.1 at %.

The γ-Ni+γ'-$Ni_3Al$ alloy composition preferably also includes at least one Pt-group metal (PGM) such as, for example, Pt, Pd, Ir, Rh or combinations thereof. Pt and Ir are preferred Pt-group metals, and Pt is particularly preferred. The total concentration of Pt-group metals in the alloy composition is preferably less than about 20 at %, more preferably less than about 10 at %, even more preferably less than about 5 at %, and most preferably about 2.5 at % to about 5 at %. If the Pt-group metals are selected from Pt and Ir, the Pt-group metals are most preferably present in the alloy composition at about 2.5 at % Pt and about 2.5 at % Ir, with a total of about 5 at %.

The γ-Ni+γ'-$Ni_3Al$ alloy composition may optionally further include up to about 20 at % of strengthening elements such as Cr and/or Si to enhance certain alloy properties such as, for example, strength and corrosion resistance. The Cr is preferably present in the alloy composition at about 5 at % to about 8 at %. In addition to or in place of the Cr, the alloy composition may optionally include up to about 3 at % Si, more preferably about 0.2 at %.

The γ-Ni+γ'-$Ni_3Al$ alloy composition may also optionally include a refractory element or elements for conferring additional alloy strengthening. Refractory elements in this application refer to metals with high melting points such as Mo, Ta, Re, W, Ru, Ti and combinations thereof. The refractory metals may be present in the alloy composition at any concentration as long as the γ+γ' phase constitution in the composition predominates, but typically are present at up to about 5 at % to about 10 at %, more preferably about 8 at %. It has been found that these refractory elements enhance alloy properties such as creep strength, while properties such as corrosion resistance and high temperature resistance are retained. Preferred refractory elements include W, Ta, Mo and Ti.

The alloy composition may further optionally include up to 1 at % of C, B, N and combinations thereof.

Referring to FIG. 1, a portion of a phase diagram of a preferred embodiment of an alloy composition is shown in which the Pt-group metal is Pt. In this embodiment the Al concentration in the Ni—Al—Pt phase diagram is selected with respect to the concentrations of Ni and Pt such that the alloy falls within the shaded region A between the γ-Ni and the γ'-$Ni_3Al$ phase fields.

As noted above, selection of the Al content in the alloys has a significant impact on whether or not they are heat treatable (i.e., able to be single-phase γ-Ni at some elevated temperature and two-phase γ-Ni+γ'-$Ni_3Al$ at lower temperatures). For example, a particularly preferred heat treatable alloy includes about 9 at % Al to about 14 at % Al and about 0.1 at % to about 0.3 at % Hf and the remainder Ni. These alloys may optionally include about 10 at % Cr. Typical examples (at %) include: Ni-13Al-0.1Hf, Ni-13Al-5Cr-0.1Hf, and Ni-13Al-10Cr-0.1Hf.

If a Pt-group metal is present, the heat treatable alloy preferably includes about 9 at % to about 13 at % Al, about 0.1 at % to about 0.3 at % Hf, about 2.5 at % to about 16 at % Pt, and Ni. The Pt-group metal containing alloys may further optionally include about 5 at % to about 10 at % Cr. Examples (at %) include Ni-13Al-5Pt-0.1Hf, Ni-13Al-16Pt-0.1Hf, Ni-13Al-5Pt-8Cr-0.1Hf and Ni-15Al-16.0Pt-5Cr-0.3Hf.

The alloys may be prepared by techniques such as, for example, argon-arc melting pieces of high-purity Ni, Al, Pt-group metals, reactive and/or strengthening metals, as well as optional refractory metals and combinations thereof. The alloys are typically cast using conventional processes and exist in bulk form, which in this application refers to free-standing cast shapes that nominally have substantially the same composition throughout. The cast shapes may be made into a wide variety of structural materials, including foils, sheets, bars, and cladding, and are particularly well suited for structural applications or for protecting an underlying substrate against high temperatures. In this application the term cladding refers to two alloys in contact, with a diffusive bond between them. The alloys may even be applied as a coating on a substrate using, for example, thermal spraying techniques such as plasma-arc spraying and high-velocity oxygen-fuel spraying or physical vapor deposition methods including magnetron sputtering or electron beam-based processes.

When thermally oxidized, the γ-Ni+γ'-$Ni_3Al$ bulk alloys described in this application grow a highly adherent α-$Al_2O_3$ scale layer during both isothermal and cyclic oxidation at high temperatures up to about 1150-1200° C.

Once a cast shape is formed having an appropriate concentration of Al, one or more reactive metals, and Ni selected to retain a predominately γ-Ni+γ'-$Ni_3Al$ phase structure, the cast shape may be thermally treated to obtain a desired microstructure and further enhance the properties of the material for a particular application. A wide variety of thermal treatment processes may be used to tailor the microstructure of the bulk alloy for a particular application.

As noted above, if the concentration of Al is maintained within a selected range, the resulting γ-Ni+γ'-$Ni_3Al$ alloy is heat treatable. Suitable thermal treatments include the precipitation heat treatment processes exemplified below, which has at least a solution treatment step, a quenching step and an aging step. However, this application is not limited to such a thermal treatment process, and a wide variety of processes may be used to tailor the microstructure of the bulk alloy for a particular application.

For example, in one precipitation heat treatment process the cast shape with constituent metals selected to have a predominately γ-Ni+γ'-$Ni_3Al$ phase structure is first thermally heated to or above a temperature sufficient to substantially dissolve the γ'-$Ni_3Al$ phase and form a single γ-Ni phase. This solution treatment step is typically performed by thermally heating the cast shape in pre-heated furnace from room temperature to a temperature of about 1200 to about 1300° C. for about 0.5 to about 6 hours.

The solution treatment step is followed by a first quenching step in which the temperature of the cast shape is quickly returned to room temperature, typically by quenching in water. During the quenching step the γ'-$Ni_3Al$ phase precipitates to form a phase assemblage with γ'-$Ni_3Al$ precipitates distributed in a γ-Ni matrix.

Following the first quenching step, the cast shape is again thermally treated for a longer period of time at a lower temperature than used in the solution treatment step described above to substantially uniformly distribute the γ'-$Ni_3Al$ precipitates, as well as any reactive, strengthening or refractory elements present in the composition, within the γ-Ni matrix. This aging step is typically performed by inserting the cast shape into a pre-heated furnace and heating from room temperature to a temperature of about 800 to about 1000° C. for about 1 to about 24 hours.

The aging step is followed by a second quenching step in which the temperature of the cast shape is quickly returned to room temperature, typically by quenching in water.

During the solutionizing or in the as-quenched stage of the heat treatment, the cast shape may be processed for a particular application, such as, for example, by rolling into a heat-protective foil. Typically, foils with a thickness of about 1 mm or less can provide substantial thermal and corrosion protection for an underlying substrate, and are quite lightweight.

The concentrations of the constituent elements and the precipitation heat treatment conditions may be selected to provide a cast shape with the compositions described above, as well as a desired microstructure for a particular application. Preferred alloys have a microstructure with a phase constitution of about 30 volume % (vol %) to about 70 vol %, or about 30 vol % to about 60 mvol %, of γ'-$Ni_3Al$ precipitates distributed substantially uniformly in a γ-Ni matrix.

EXAMPLES

Example 1

Heat Treatability

High purity alloys were Ar-arc melted and drop cast to provide cast shapes with the following alloy compositions (all compositions in the examples below are set forth in at %):

Ni-15Al-2.5Pt-0.1Hf
Ni-15Al-2.5Pt-5Cr-0.1Hf
Ni-15Al-2.5Ir-0.1Hf
Ni-15Al-2.5Ir-5Cr-0.1Hf
Ni-15Al-2.5Pt-2.5Ir-0.1Hf
Ni-15Al-2.5Pt-2.5Ir-5Cr-0.1Hf

For oxidation testing, the samples were annealed at 1200° C. for 6 hours, followed by thermal treatment at 1150° C. for 48 hours in flowing Ar.

For microstructural characterization, the samples were first placed in a pre-heated furnace and thermally treated at 1300° C. for 1 hour, then rapidly quenched in water to reduce the temperature of the samples to room temperature.

Example 2

Comparison of Microstructures

Figure 2:
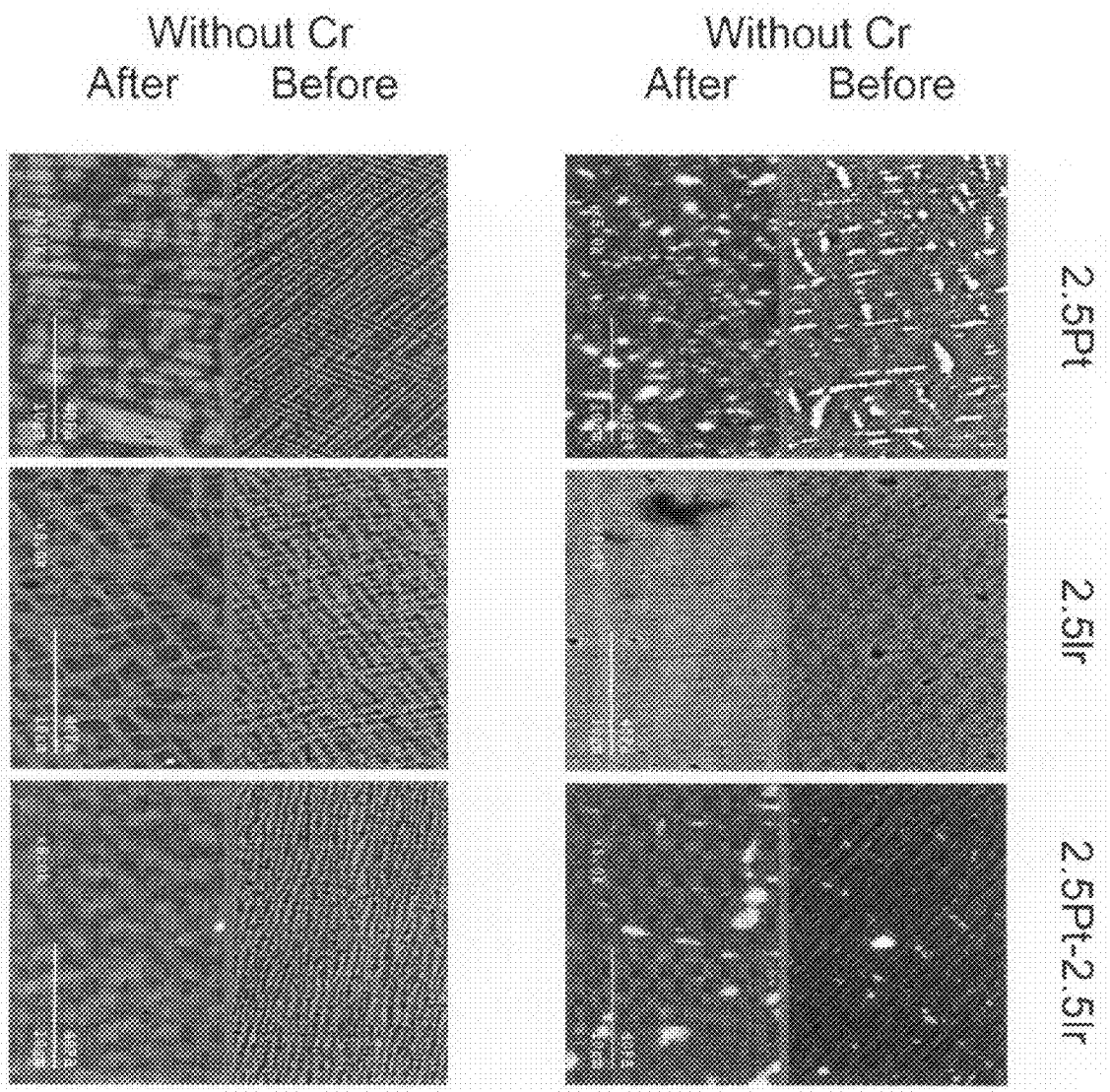
FIG. 2 is a series of cross-sectional images of selected alloys of Example 1.

The microstructure of the resulting samples is shown in the photographs of FIG. 2, where it is evident that the Cr-containing alloys exhibit a much higher γ' volume fraction in comparison to their Cr-free counterparts. FIG. 2 compares the as-heat-treated microstructures of the Ni-15Al-0.1Hf base alloys containing 2.5Pt, 2.5Ir or 2.5Pt+2.5Ir addition and with and without further addition of 5Cr (FIG. 2A) to the microstructures resulting after a further 100 hours exposure at 1000° C. The Cr-containing alloys apparently underwent a significant amount of γ' coarsening.

Example 3

Isothermal Oxidation Resistance

Figure 3A:
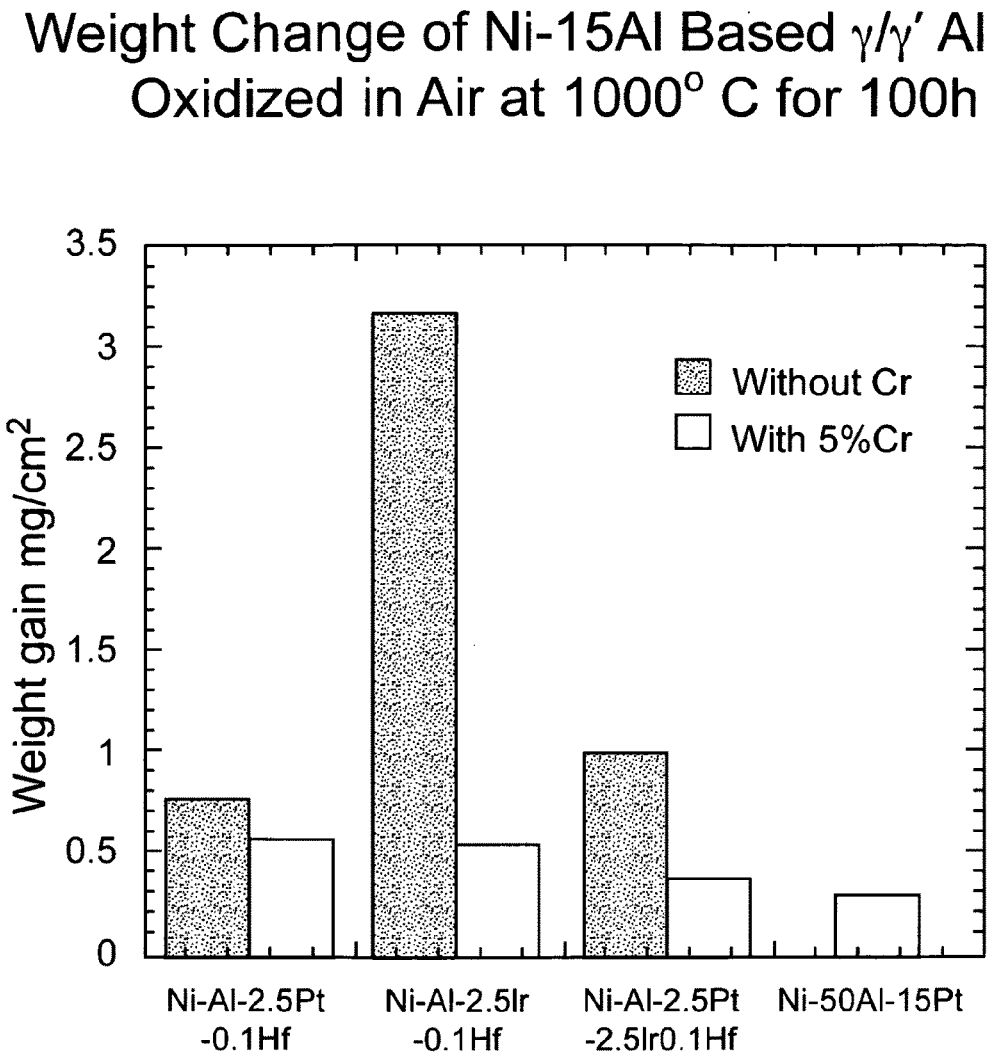
FIG. 3A is a plot showing weight change of the alloys of Example 1 after substantially isothermal exposure at 1000° C. for 100 hours in still air. The weight gain for a Ni-50Al-15Pt alloy is included for reference to the oxidation behavior of a Pt-modified β3-NiAl system.

The samples from Example 1 were then oxidized in air at 1000° C. for 100 hours, and the measured weight change results (due to oxygen uptake) are shown in FIG. 3A.

FIG. 3A shows the significant benefit of Cr addition to the oxidation resistance of each. In particular, the weight gain of the Ni-15Al-2.5Ir-0.1Hf alloy was reduced by more than a factor of six by the addition of 5 Cr. Moreover, the weight gain of this alloys is seen in FIG. 3A to be comparable to that of a Pt-modified β-NiAl alloy.

Figure 3B:
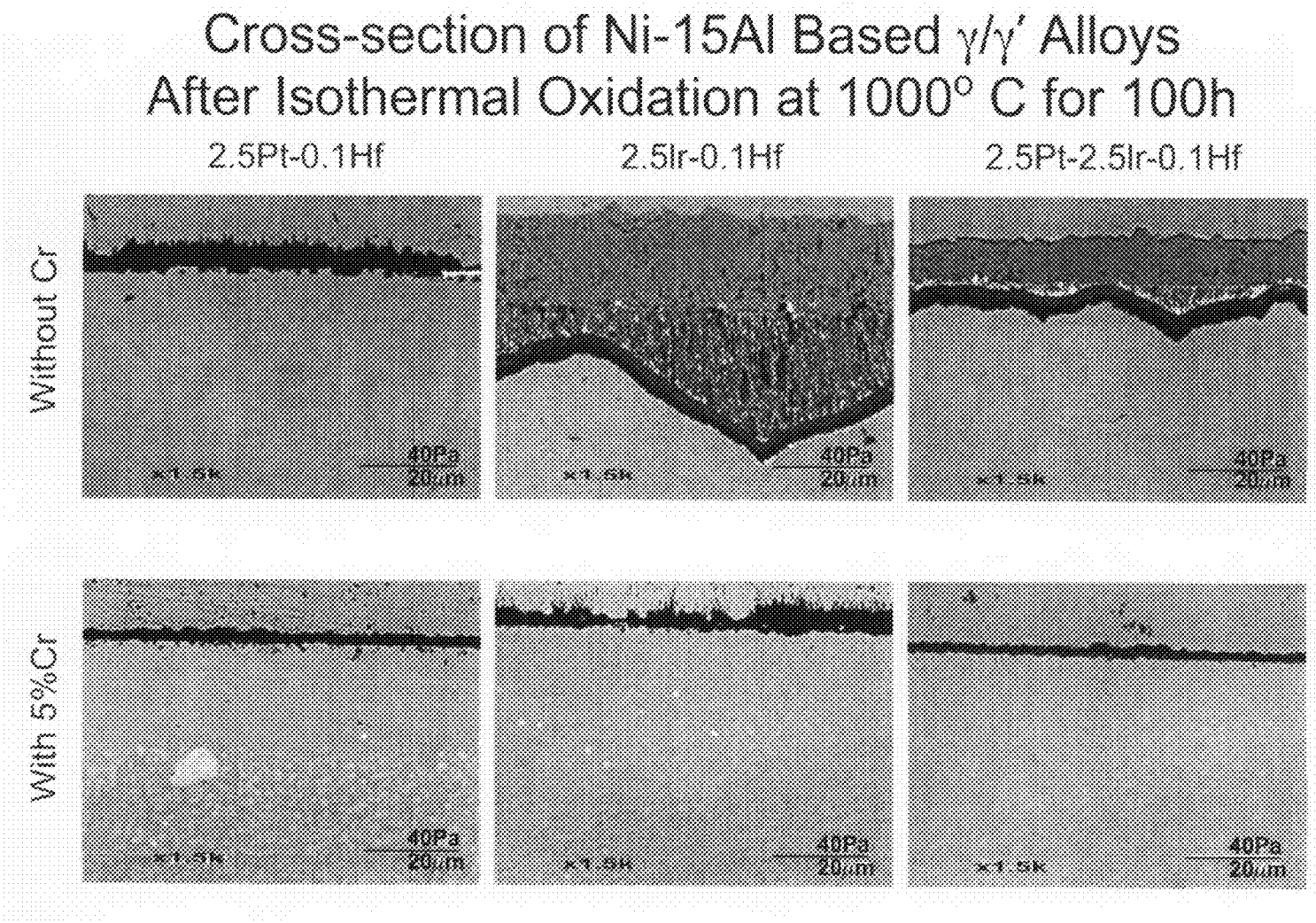
FIG. 3B is a series of cross-sectional images of selected alloys of Example 1 after substantially isothermal exposure at 1000° C. for 100 hours in still air.

Cross-sectional photographs of the FIG. 3A samples are shown in FIG. 3B, where the samples without Cr exhibited thick oxidation, likely a Ni-rich oxide and an alumina oxide. On the other hand, the samples with Cr had a considerably thinner (more slow-growing) scale of $Al_2O_3$, which indicates that Cr alters the behavior of the system at elevated temperatures in such a way that it facilitates the preferential formation and growth of a primarily $Al_2O_3$ scale (i.e., helps prevent the formation of the fast-growing, Ni-rich oxide shown in FIG. 3B for the samples without Cr).

Example 4

Cyclic Oxidation Resistance

Figure 4A:
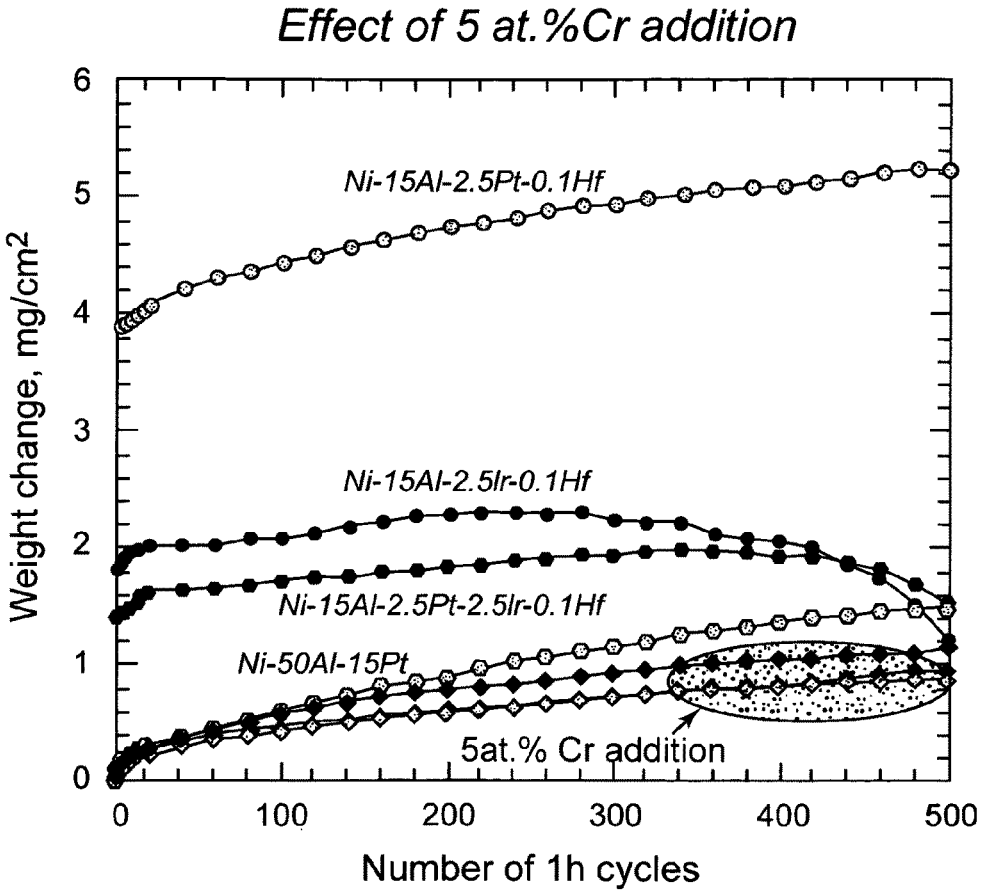
FIGS. 4A-4B are plots showing the cyclic oxidation weight-change kinetics at 1150° C. in air of various alloys of Example 1. The kinetics for a Ni-50Al-15Pt alloy are included for reference to the oxidation behavior of a Pt-modified β3-NiAl system.
Figure 4B:
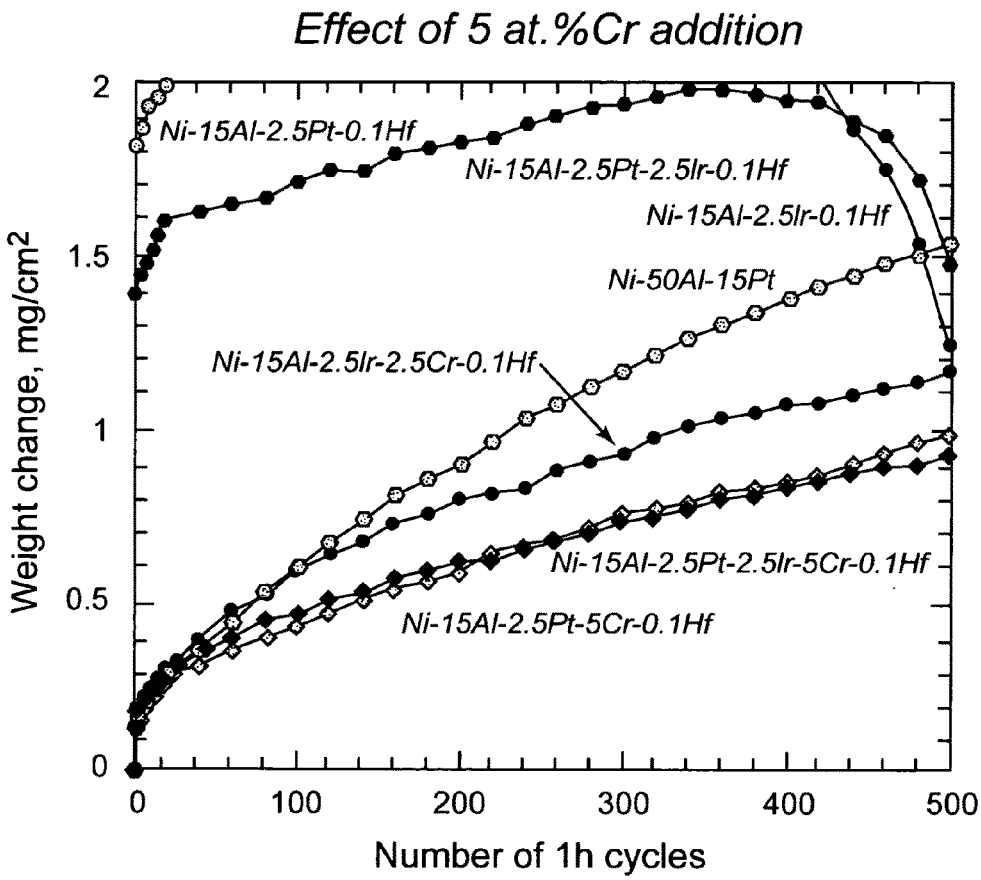
Figure 4C:
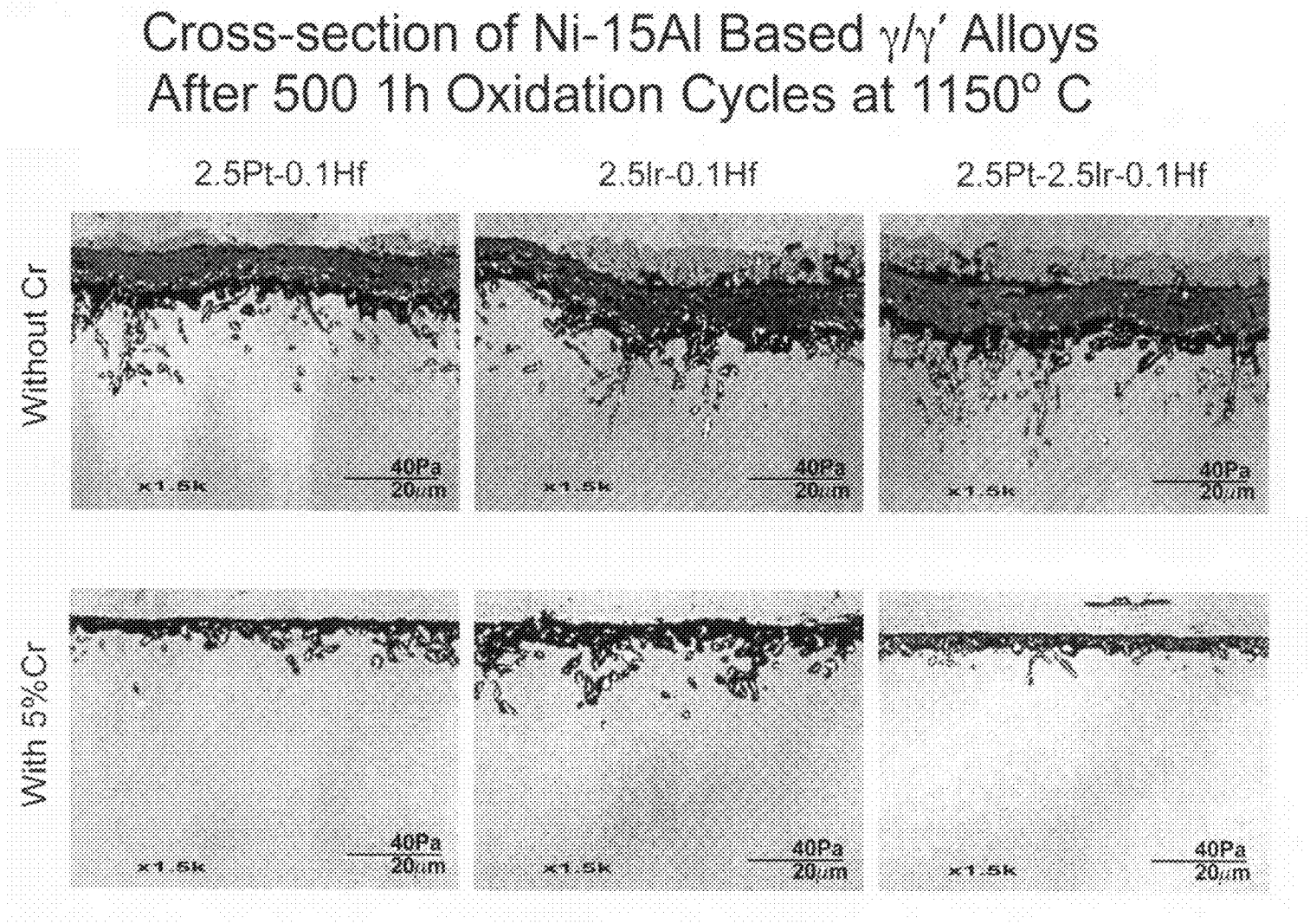
FIG. 4C is a series of cross-sectional images of alloys of Example 1 after 500 1 hour oxidation cycles at 1150° C. in air.

The samples from Example 1 were then oxidized at 1150° C. under thermal cycles, and the results are shown in FIGS. 4A-4C.

FIG. 4A shows the highly beneficial effect of 5 at. % Cr addition on the 1150° C. cyclic oxidation kinetics of the three precious-metal (PM; which as used herein refers to Pt, Ir and combinations thereof) modified Ni-15Al-0.1Hf base alloys reported in the previous section.

The same plot is enlarged in FIG. 4B. For comparison, the cyclic-oxidation kinetics of a Pt-modified β-NiAl alloy (Ni- 50Al-15Pt composition) are included. It is seen that the Cr+PM-modified alloys oxidized at a much slower rate than the β alloy. Interestingly, Cr addition apparently nullified the longer-term detrimental effect of Ir, to the extent that the Cr+Ir-containing alloys generally exhibited slow, weight-gain kinetics over the entire test duration. Close examination of the kinetics leads to the inference that the sole addition of Pt with Cr (i.e., the Ni-15Al-2.5Pt-5Cr-0.1Hf alloy) results in the most protective cyclic oxidation kinetics.

FIG. 4C shows the reduced oxide scale thickness in conjunction with the development of a protective single oxide layer that results from the addition of 5% Cr to the chosen alloys during 500 one-hour cycles to 1150° C. in air. In addition to the decreased oxide growth rate, the micrographs illustrate that the formation of internal hafnium oxides is reduced by the addition of 5% Cr, particularly for the alloys that contain Pt.

Example 5

Beneficial Role of Pt

Figure 5:
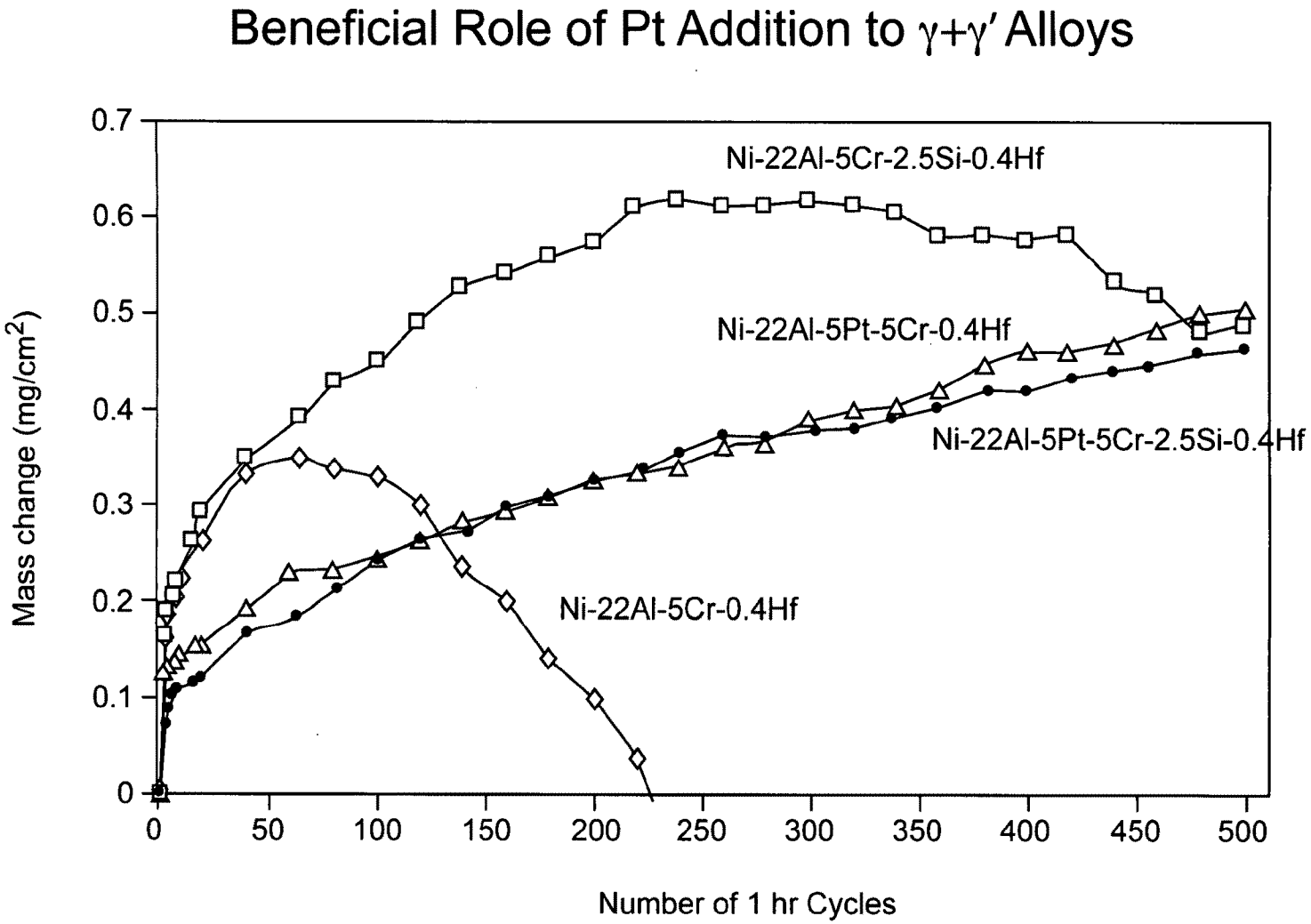
FIG. 5 is a plot showing the effect of Pt on the cyclic oxidation kinetics of selected γ-γ' alloys.

FIG. 5 shows that the addition of Pt to non-heat treatable γ+γ' alloys increases oxide scale adhesion during 500 1-hr cycles to 1150° C. in air. The two alloys without Pt suffer from significant scale spallation after a few hundred cycles.

Example 6

Effect of Reactive Element on Oxidation Resistance

Figure 6:
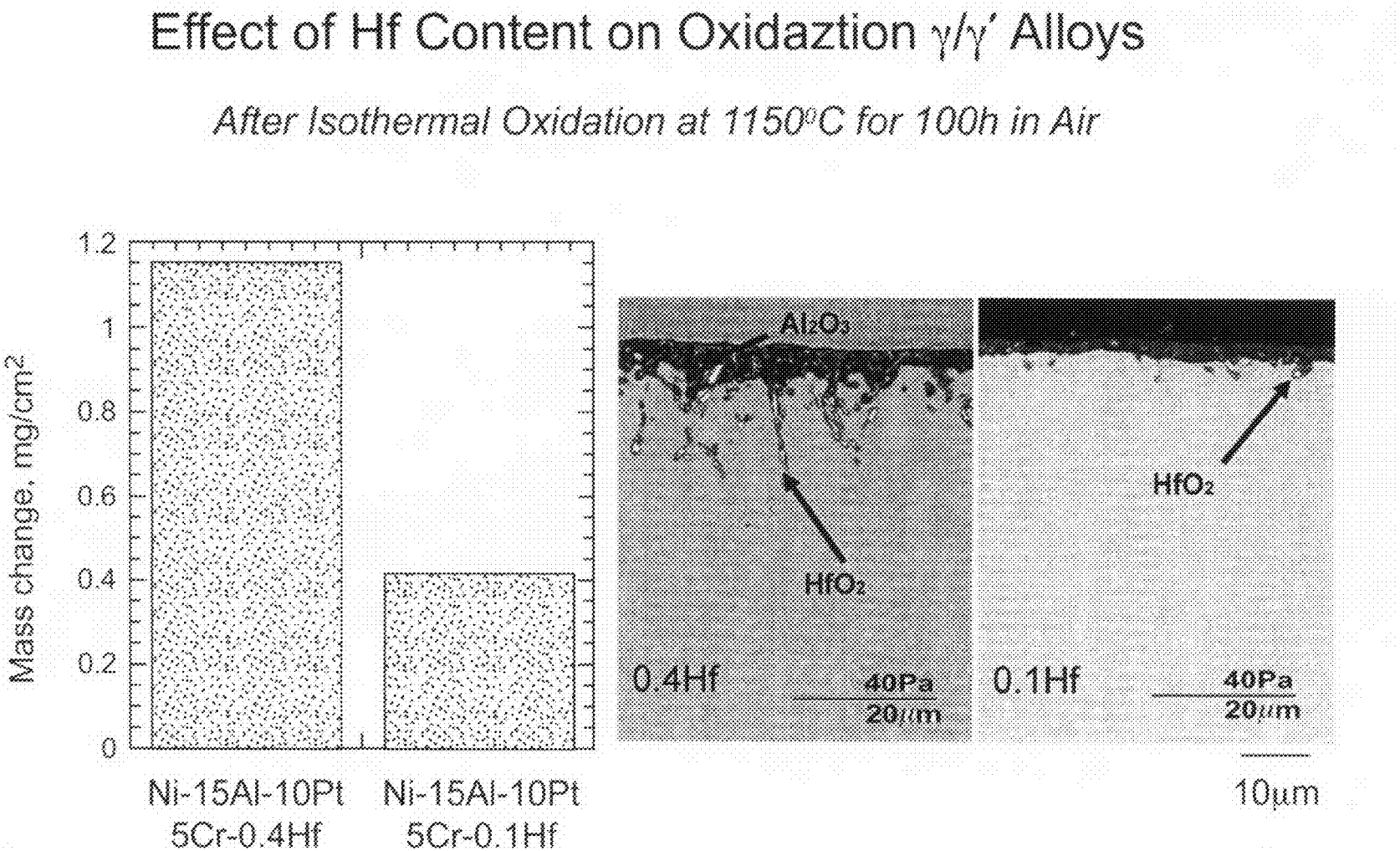
FIG. 6 is a plot and a series of cross-sectional images showing the effect of Hf content on the oxidation resistance of γ-γ' alloys.

FIG. 6 shows that there is a preferred amount of Hf to be added to heat-treatable Ni-15Al-10Pt-5Cr alloys to minimize isothermal oxidation at 1150° C. for 100 hr in air. As illustrated in the corresponding cross-sectional micrographs, a higher level of Hf (e.g., about 0.4%) promotes significant formation of hafnium oxide phases beneath the growing aluminum oxide scale, which causes a higher weight gain. In contrast, reducing the level of Hf (i.e., about 0.1%) helps limit the formation of hafnium oxide, constraining it to near the growing aluminum oxide scale/substrate interface.

Example 7

Microstructure of Heat-treated Alloys

Figure 7:
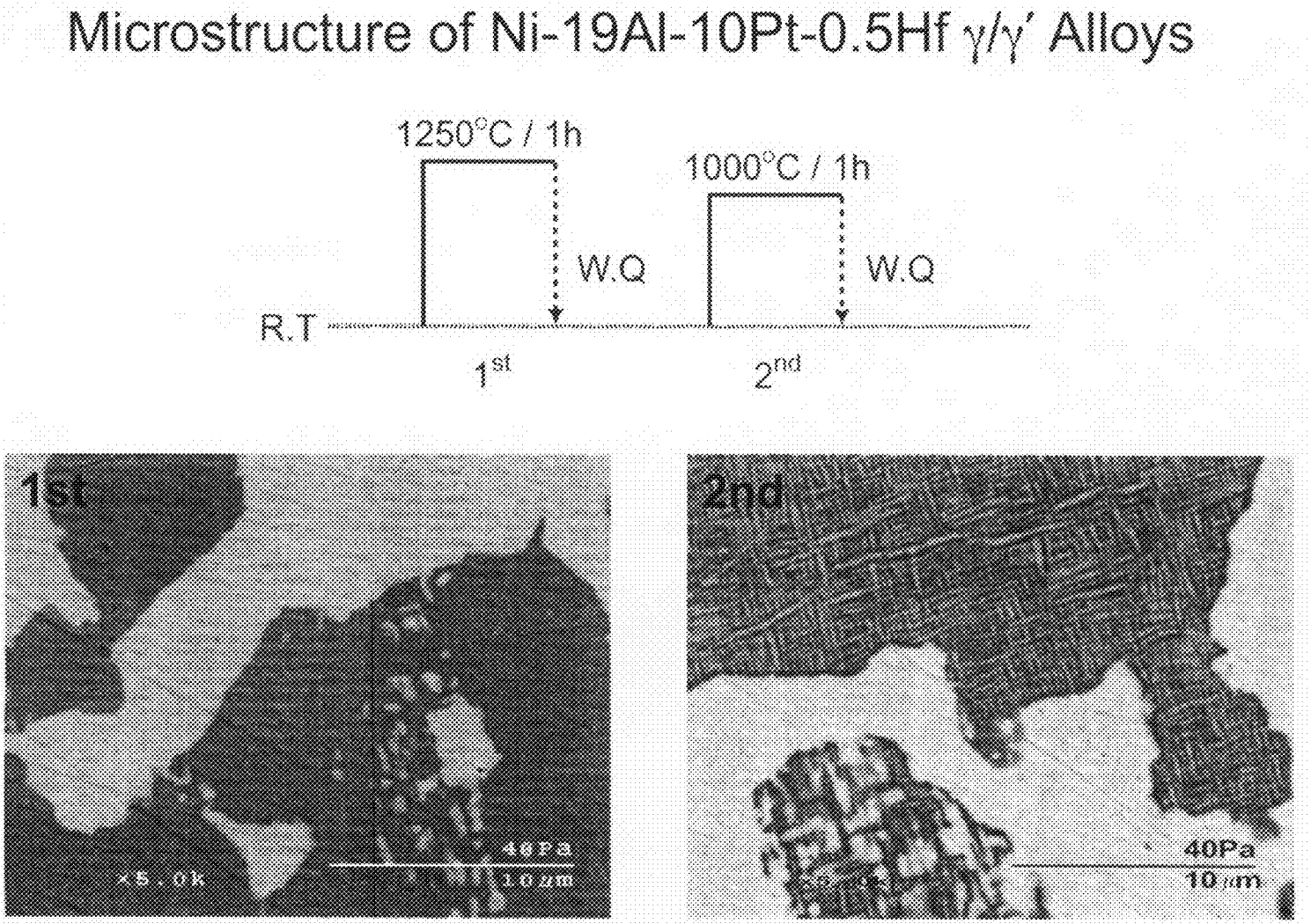
FIG. 7 shows a series of cross-sectional images of a heat-treatable γ+γ' alloy.

FIG. 7 shows a fully solutionized (i.e., single-phase gamma structure) microstructure (left) for a heat-treatable gamma+gamma prime alloy heat treated and homogenized at 1250° C. for 1 hour and then quenched in water. Subsequently, this single-phase structure has heat treated at 1000° C. in air for 1 hour and quenched in water to retain the two-phase structure that developed at 1000° C. (right). The γ' phase that precipitated coherently within the γ matrix is illustrated by the lighter-gray platelet-shaped grains in the darker-gray regions.

Example 8

Isothermal and Cyclic Oxidation Behavior

Figure 8A:
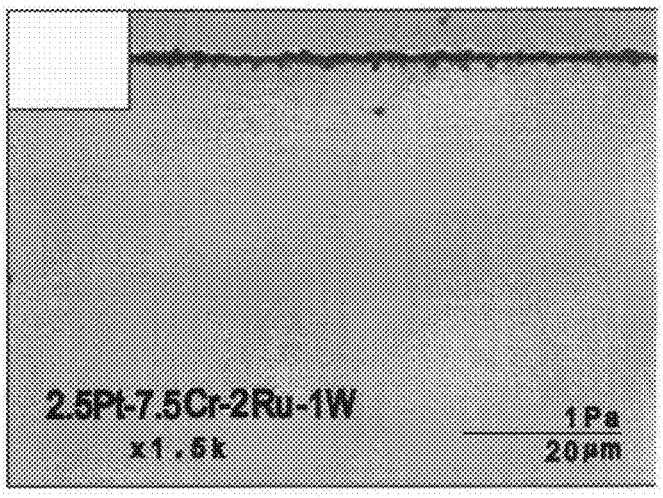
FIGS. 8A-8C are SEM cross-sectional images of modified Ni-13Al-0.1Hf-based alloys after 100 hours isothermal oxidation at 1000° C. in air.
Figure 8B:
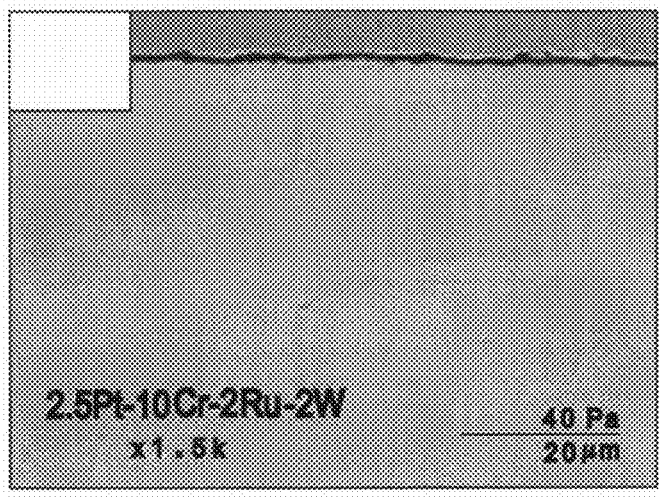
Figure 8C:
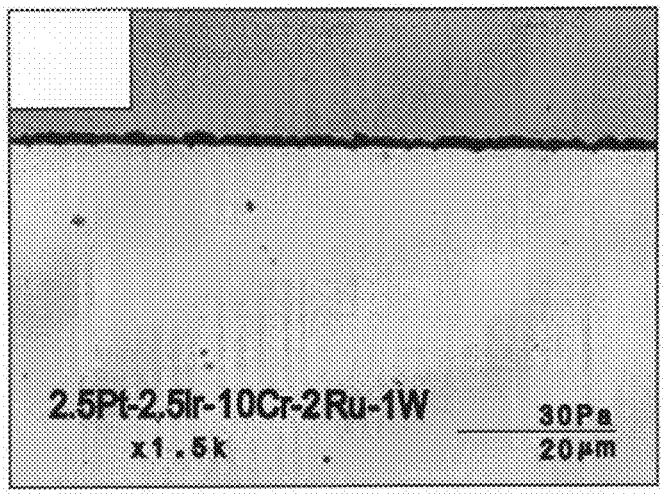
Figure 9:
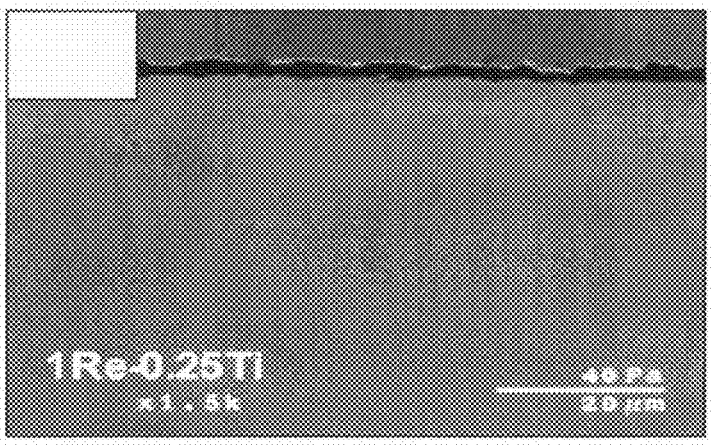
FIG. 9 is a SEM cross-sectional image of Ni-13Al-10Cr-2.5Pt-2.5Ir-2Ru-1W-2Ta-1Re-0.25Ti-0.1Hf based alloys after 100 hours isothermal oxidation at 1000° C. in air.

The oxidation behavior of PGM-modified γ+γ' alloys with 13 at % Al and 0.1 at % Hf were assessed under both isothermal and cyclic conditions at 1000® C. in air. Cross-sectional SEM images of selected alloys after 100 hour isothermal oxidation are shown in FIG. 8A. For an alloy containing 7.5 at % Cr, the oxide scale which formed depends on the alloy composition. For example, a multi-layered scale forms on the Ni-13Al-2.5Pt-2.5Ir-7.5Cr-2Ru-2W-0.1Hf alloy, while an exclusive $Al_2O_3$ scale forms on Ni-13Al-2.5Pt-7.5Cr-2Ru-1W-0.1Hf (FIG. 8A). By contrast, an exclusive $Al_2O_3$ layer forms on most alloys containing 10 at % Cr and less than 10 at % refractory element additions (FIGS. 8B and 8C). An example of an even higher alloyed 10 at % Cr system (compared to those shown in FIG. 1) forming an exclusive $Al_2O_3$ is shown in FIG. 9.

Figure 10A:
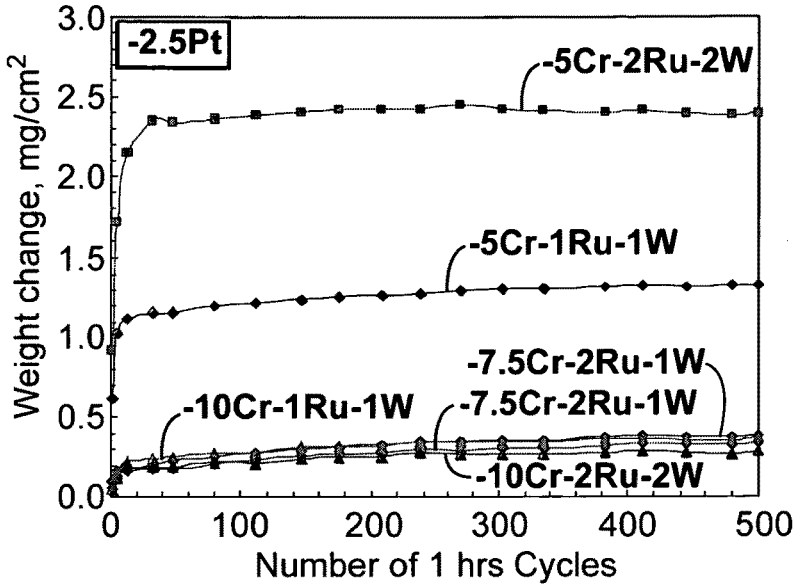
FIGS. 10A-10B are plots of the cyclic oxidation kinetics at 1000° C. in air of precious group metal (PGM: Pt and/or Ir)-modified γ+γ' alloys with 13 at % Al and 0.1 at % Hf, with FIG. 10A showing 2.5Pt and FIG. 10B showing 2.5Pt-2.5Ir.
Figure 10B:
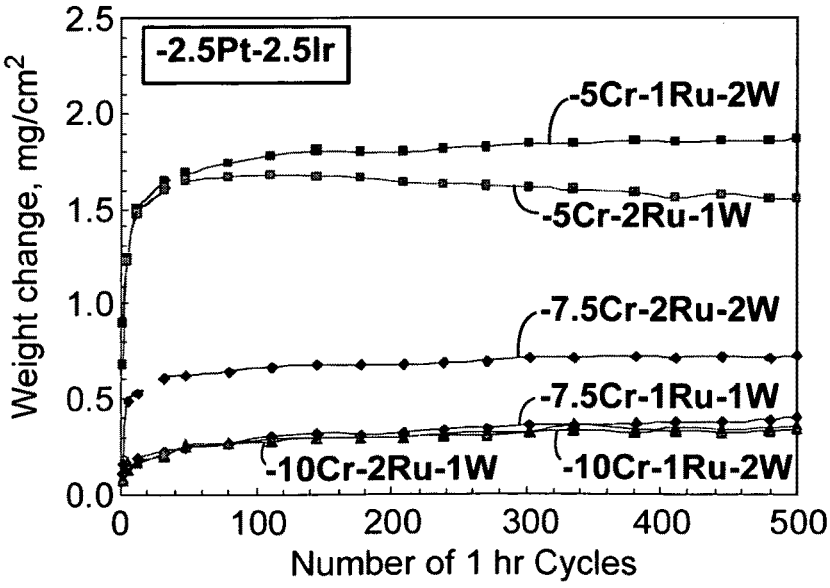
Figure 11:
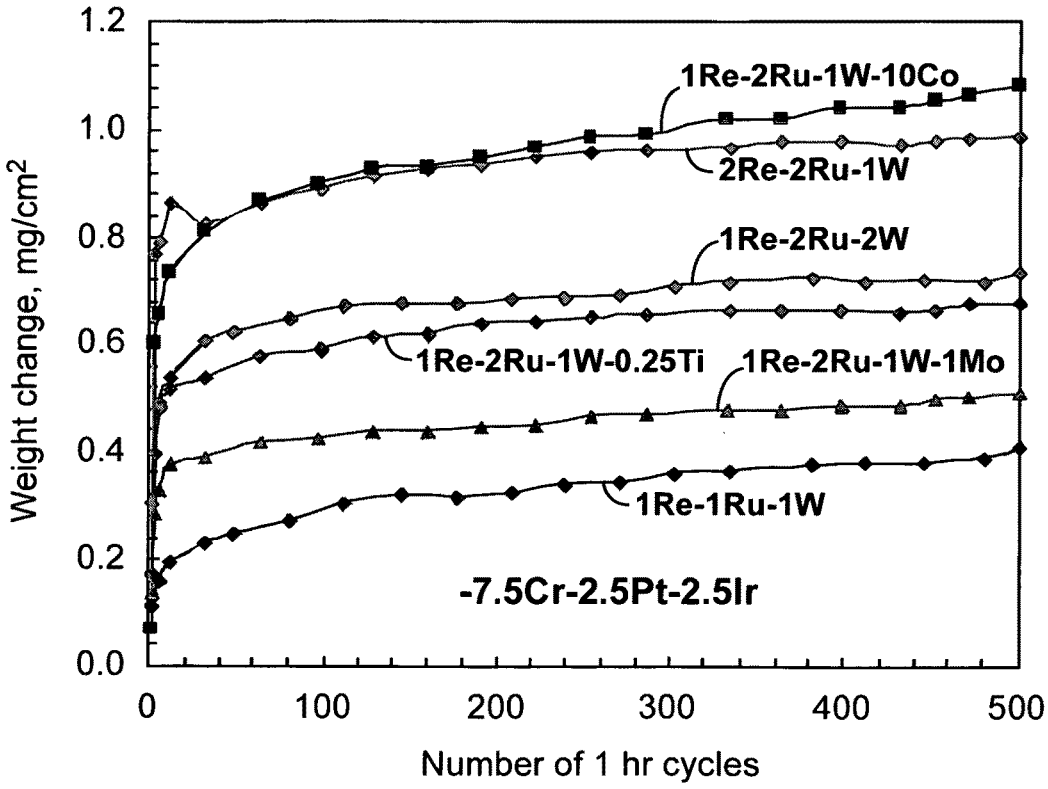
FIG. 11 is a plot of the cyclic oxidation kinetics at 1000° C. in air of Ni-13Al-2.5Pt-2.5Ir-7.5Cr-based alloys.

FIGS. 10A-10B and 11 show the cyclic oxidation kinetics of various PGM modified γ+γ' alloys with 13 at % Al and 0.1 at % Hf. In these plots, each cycle consists of 1 hr at 1000° C. followed by 30 minutes at ~75° C. All alloys except those containing –2.5Pt-5Cr-1Re-2Ru-2W and –2.5Pt-2.5Ir-5Cr-1Re-2Ru-1W underwent a relatively large initial weight gains followed by significantly slower weight-gain kinetics. Both of these alloys eventually underwent weight loss due to oxide scale spallation. These data indicate that the level of Cr, more than any other element, has a significant effect on the oxidation kinetics. The alloys containing 5 at % Cr showed a weight gain typically above about 1.2 mg/cm$^2$ after 500 cycles, alloys containing 7.5 at % Cr had weight gain variations from 0.3 to 1.1 mg/cm$^2$ depending on composition, and finally alloys containing 10 at % Cr showed a weight gain below 0.4 mg/cm$^2$.

A number of embodiments of the invention have been described. Nevertheless, it will be understood that various modifications may be made without departing from the spirit and scope of the invention. Accordingly, other embodiments are within the scope of the following claims.

What is claimed is:

1. An alloy consisting of 5 at %≤Al<16 at %, about 2.5 at % to about 5 at % of a Pt-group metal selected from the group consisting of Pt, Pd, Ir, Rh and Ru, and combinations thereof, about 0.05 at % to 1 at % of a reactive element selected from the group consisting of Hf, Y, La, Ce and Zr, and combinations thereof, a refractory metal selected from the group consisting of Mo, Ta, Re, W, Ti and combinations thereof, at least one of C, B, N and combinations thereof, and Ni, wherein the alloy has a predominately γ-Ni+γ'-$Ni_3Al$ phase constitution.

2. The alloy of claim 1, wherein the Pt-group metal is Pt and the reactive element is Hf.

3. An alloy consisting of 5 at %≤Al<16 at %, about 2.5 at % to about 5 at % of a Pt-group metal selected from the group consisting of Pt, Pd, Ir, Rh and Ru, and combinations thereof, about 0.05 at % to 1 at % of a reactive element selected from the group consisting of Hf, Y, La, Ce and Zr, and combinations thereof, and Ni, wherein the alloy has a predominately γ-Ni+γ'-$Ni_3Al$ phase constitution.

4. The alloy of claim 3, wherein the Pt-group metal is selected from Pt, Ir and combinations thereof.

5. The alloy of claim 4, wherein the Pt-group metal is present at about 2.5 at % to about 5 at %.

6. The alloy of claim 4, wherein the Pt-group metal consists of about 2.5 at % Pt and about 2.5 at % Ir.

7. The alloy of claim 3, wherein the Pt-group metal is Pt.

8. The alloy of claim 7, wherein the reactive element is Hf.

9. A bulk alloy consisting of about 13 at % Al to about 15 at % Al, about 0.05 at % to about 0.5 at % Hf, about 2.5 at % to about 5 at % of a Pt-group metal selected from Pt, Ir and combinations thereof, up to about 5 at % of a refractory metal selected from the group consisting of Mo, Ta, Re, W, Ru, Ti and combinations thereof, and Ni, wherein the alloy has a predominately γ-Ni+γ'-$Ni_3Al$ phase constitution.

10. The bulk alloy of claim 9, wherein the bulk alloy is a foil with a thickness of less than about 1 mm.

11. An alloy consisting of 5 at %≤Al<16 at %, about 0.05 at % to 1 at % of a reactive element selected from the group consisting of Hf, Y, La, Ce and Zr, and combinations thereof, and Ni, wherein the alloy has a predominately $\gamma$-Ni+$\gamma'$-$Ni_3Al$ phase constitution.

12. The alloy of claim 11, wherein Al is present in the alloy at 9 at %≤Al<14 at %, and the reactive element is present in the alloy at 0.05 to about 0.5 at %.

13. The alloy of claim 12, wherein the reactive element is present at about 0.1 at %.

14. The alloy of claim 11, wherein the reactive element is Hf.

* * * * *